US007261527B2

(12) United States Patent
Alexander et al.

(10) Patent No.: US 7,261,527 B2
(45) Date of Patent: Aug. 28, 2007

(54) COMPRESSOR CHECK VALVE RETAINER

(75) Inventors: Daniel F. Alexander, Sparkman, AR (US); Jay Andrew Herbert, Arkadelphia, AR (US); Carlos A. Zamudio, Arkadelphia, AR (US)

(73) Assignee: Scroll Technologies, Arkadelphia, AK (US)

( * ) Notice: Subject to any disclaimer, the term of this patent is extended or adjusted under 35 U.S.C. 154(b) by 233 days.

(21) Appl. No.: 10/827,411

(22) Filed: Apr. 19, 2004

(65) Prior Publication Data

US 2005/0232798 A1 Oct. 20, 2005

(51) Int. Cl.
*F01C 1/02* (2006.01)
*F03C 2/00* (2006.01)

(52) U.S. Cl. ..... 418/55.1; 418/270

(58) Field of Classification Search ..... 418/1, 418/55.1–55.6, 57, 270; 137/511, 512, 852, 137/853, 855

See application file for complete search history.

(56) References Cited

U.S. PATENT DOCUMENTS 2,909,188 A * 10/1959 Billington ..... 137/517
5,346,375 A * 9/1994 Akiyama et al. ..... 418/55.1
6,027,321 A * 2/2000 Shim et al. ..... 418/55.1
6,544,016 B2 * 4/2003 Gennami et al. ..... 418/55.1
6,641,379 B1 11/2003 Dewar et al.
6,749,412 B2 * 6/2004 Narasipura et al. ..... 418/55.1

FOREIGN PATENT DOCUMENTS

JP 03242483 A * 10/1991 ..... 418/55.1
JP 05272472 A * 10/1993 ..... 418/55.1

* cited by examiner

*Primary Examiner*—Theresa Trieu
(74) *Attorney, Agent, or Firm*—Carlson, Gaskey & Olds

(57) ABSTRACT

A scroll compressor has a sealed housing. Within the sealed housing is a first scroll member having a first base and a first generally spiral wrap extending form the first base. A second scroll member has a second base and a second generally spiral wrap extending from the base. The wraps of the first and second scroll members interfit to define compression chambers. A motor drives the second scroll member to orbit relative to the first scroll member. A valve controls the communication of gas between the compression chambers and a discharge pressure chamber. The valve is retained within a valve chamber of the first scroll member. A valve retainer is used to keep the valve within the valve chamber. The valve retainer is attached to the first scroll member by a snap fit connection.

9 Claims, 4 Drawing Sheets

COMPRESSOR CHECK VALVE RETAINER

BACKGROUND OF THE INVENTION

This invention relates to a scroll compressor having a retainer for a discharge check valve.

One popular type of modern compressor is a scroll compressor. A scroll compressor includes a pair of scroll members each having a base and a generally spiral wrap extending from the base. The wraps of the two scroll members interfit to define compression chambers. One of the scroll members is driven to orbit relative to the other. During this orbital movement, the compression chambers decrease in volume to thereby compress refrigerant within the chambers.

Compressors are typically mounted within a sealed container. For such compressors, the pump unit for compressing the refrigerant is positioned at one end, and a motor for driving the pump unit is positioned at another end. Often the suction pressure refrigerant is allowed to circulate over the motor for cooling. Consequently, it becomes necessary to separate a suction pressure chamber from a discharge pressure chamber.

In traditional scroll compressors, the non-orbiting scroll does not seal against the compressor housing. Instead, a separate plate is positioned outwardly of the base of the non-orbiting scroll to separate the housing into suction and discharge pressure chambers. Most typically, a discharge pressure chamber is formed above the separator plate, and the area below the separator plate is at suction pressure.

More recently, it has been proposed to incorporate the separator function into the base of the non-orbiting scroll. In such compressors, the base of the non-orbiting scroll is sealed to the housing. Thus, there is the discharge pressure chamber on one side of the base of the non-orbiting scroll and the suction pressure chamber on the other.

For the foregoing conventional designs, refrigerant from the suction chamber is compressed in the compression chambers and typically passes through a check valve, to the discharge pressure chamber. Typically, as shown by FIG. 8, the check valve is retained by a valve retainer, such as valve retainer 204, within valve chamber 206 of non-orbiting scroll member 200. To permit compressed refrigerant to pass from valve chamber 206 to a discharge pressure chamber, the non-orbiting scroll member 200 is provided with gas passages 208, which are machined into the non-orbiting scroll member 200. Valve retainer 204 is lodged between the gas passages 208 of valve chamber 206 by press fitting the retainer 204 on the edges of the gas passages 208.

The above design, while successful, does carry some challenge to manufacture. Specifically, because valve retainer 204 is press fit between the gas discharge passages 208, valve chamber 206 must be machined with great precision. However, machining valve chamber 206 is difficult and time consuming. Accordingly, manufacturing the current assembly may sometimes result in rejected parts.

A need therefore exists for an improved design for the valve retainer that avoids the time consuming process of machining the non-orbiting scroll and easily allows retention of the compressor's check valve.

SUMMARY OF THE INVENTION

The present invention comprises a scroll compressor having a sealed housing. Like existing scroll compressors, the invention has a non-orbiting scroll with a generally spiral wrap extending from its base and an orbiting scroll having a mating generally spiral wrap extending from its base. The two spiral wraps interfit to define compression chambers. A motor drives the orbiting scroll relative to the non-orbiting scroll.

Further, a check valve, controls the passing of gas between the compression chambers and a discharge pressure chamber. The valve itself is disposed in a valve chamber of the non-orbiting scroll. A valve retainer is used to retain the valve within the valve chamber. In contrast to conventional designs, the inventive scroll compressor, however, uses a snap fit connector to mount the valve retainer to the non-orbiting scroll. The snap fit connector flexes between a disengaged position in which the valve retainer is disengaged from the non-orbiting scroll and an engaged position in which the valve retainer is engaged to the non-orbiting scroll.

The snap fit connector may have a protrusion to engage an opening. The protrusion is in the opening when engaged and out of the opening when disengaged. The opening may be a groove disposed on a rim of the valve chamber while the protrusion may be a ridge on the valve retainer.

The valve retainer may be a body spaced from the bottom of the valve chamber. The valve is trapped between the body and a valve chamber bottom. The body has holes for creating suction on a bottom of the body to retain the valve on a valve seat when the valve is opened.

The body has legs that extend between the valve chamber bottom and also extend to a valve chamber rim. The leg may be part of the snap fit connector. In this way, the valve retainer may be quickly installed into the valve chamber by a snap fit connection using the legs to connect the retainer to the non-orbiting scroll and to act as a stop to place the retainer in the valve chamber in a position for engagement of the legs to the non-orbiting scroll.

The valve retainer also has discharge passages that permit the communication of compressed refrigerant from the valve chamber to the discharge pressure chamber. In this way, the non-orbiting scroll need not be machined for these passages. The space between the legs of the valve retainer may be provided with these discharge passages.

Accordingly, a valve may be placed in a valve chamber of a non-orbiting scroll. A valve retainer is positioned relative to the valve chamber and flexed to engage the non-orbiting scroll. By snap fitting the valve retainer into the valve chamber, the valve retainer may be quickly installed on the non-orbiting scroll. Further, the snap fit connection permits a less precise fit between the valve retainer and the non-orbiting scroll. Accordingly, the valve chamber of the non-orbiting scroll need not be machined with the high precision required of conventional designs. Hence, the invention reduces part rejections in addition to labor cost.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
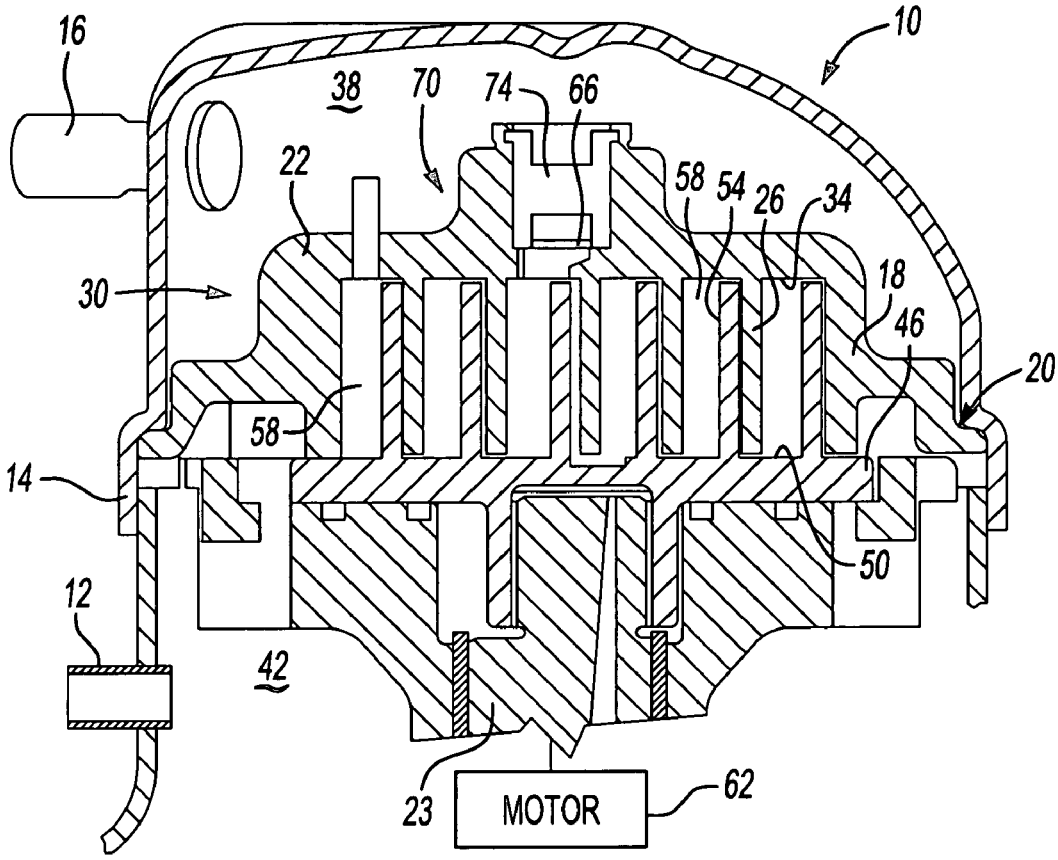
FIG. 1 illustrates a cross-sectional view of the inventive scroll compressor, showing the location of check valve, check valve retainer and valve chamber relative to the non-orbiting scroll.

A scroll compressor 10 is shown in FIG. 1. As known, a scroll compressor incorporates a first scroll member 18 and a second scroll member 46. First scroll member 18 is a non-orbiting scroll while second scroll member 46 is an orbiting scroll. First scroll member 18 has first base 22 with first side 30 and second side 34. Extending from second side 34 is first generally spiral wrap 26. Discharge pressure chamber 38 is located above first side 30 while suction pressure chamber 42 is located beneath second side 34. An outer periphery of the first scroll member 18 is sealed to an inner periphery of a housing.

Second scroll member is located at an upper extent of suction pressure chamber 42. Second scroll member 46 has second base 50 from which second generally spiral wrap 54 extends. Second generally spiral wrap 54 interfits with first generally spiral wrap 26 to define compression chambers 58, as known. Motor 62 is provided to drive shaft 23 and a drive transmission transmits orbiting movement to second scroll member 46, so as to compress refrigerant within compression chambers 58.

As known, refrigerant is brought into suction pressure chamber 42 through suction tube 12 and is passed to compression chambers 58. Refrigerant is compressed in chambers 98 and then passed through check valve 66, which opens to pass refrigerant from compression chambers 58 to discharge pressure chamber 38. Refrigerant then passes through discharge tube 16 and eventually returns to suction tube 12 as part of a cooling cycle. The foregoing features of the invention are known.

Figure 8:
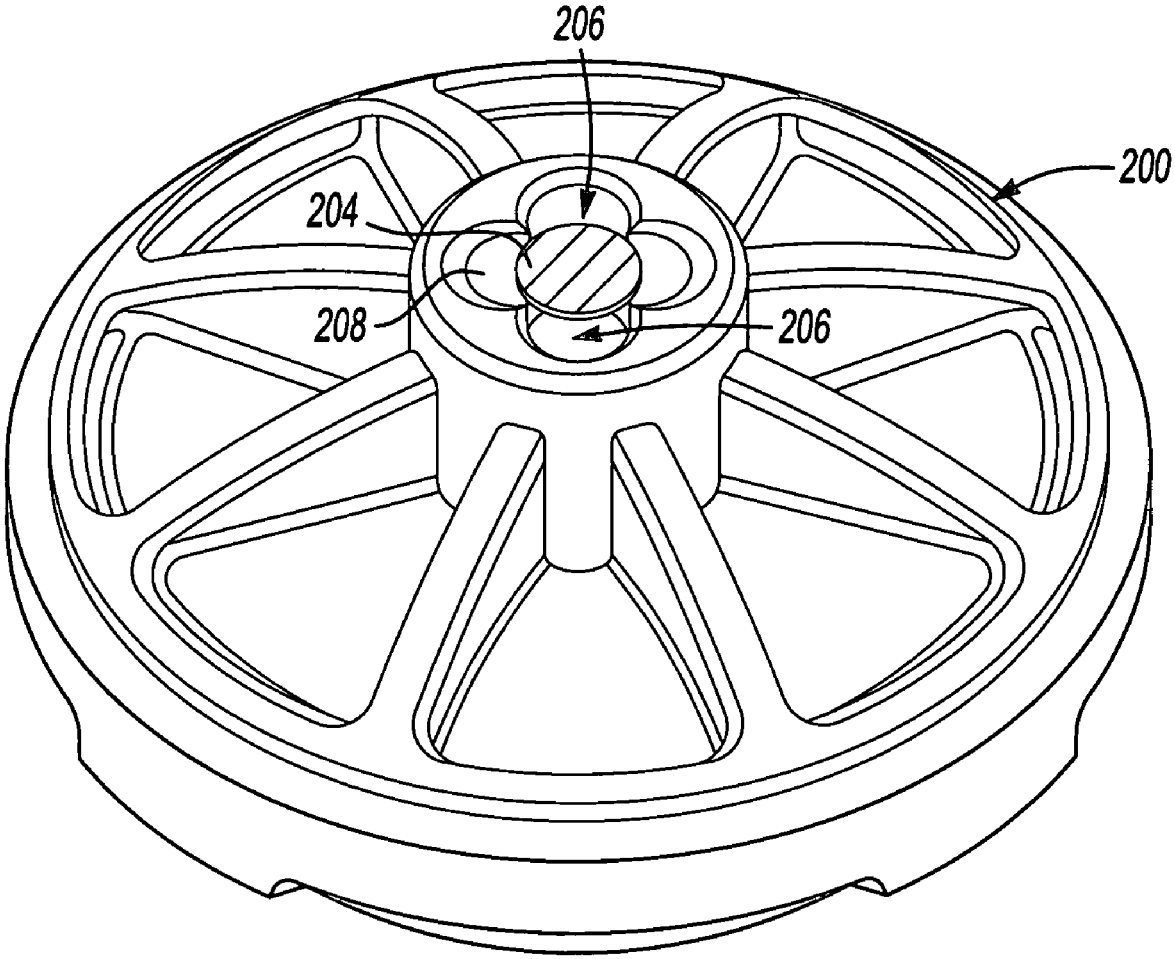
Fig-8 PRIOR ART
FIG. 8 illustrates a prior art non-orbiting scroll with valve retainer.

In contrast to existing scroll compressors, however, the inventive scroll compressor 10 has valve chamber 70, here a cylinder, with a unique valve retainer 74. Specifically, in the prior art as shown in FIG. 8, the conventional valve retainer 204 was pressed and deformed to fit into valve chamber 206, so as to impinge upon the edges of gas passages 208. This assembly technique required valve chamber 206 to be machined precisely to a diameter slightly smaller than valve retainer 204. By contrast, as explained below in detail, valve retainer 74 snap fits to first scroll member 18 thereby permitting looser tolerances between first scroll member 18 and valve retainer 74.

Figure 2:
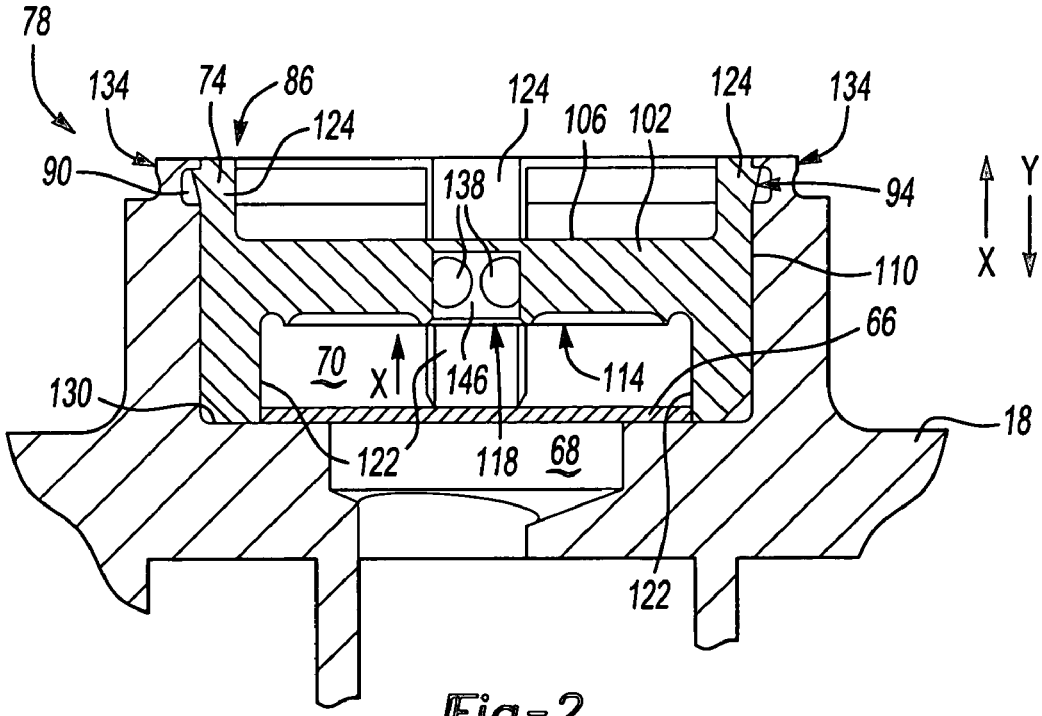
FIG. 2 illustrates a close up view of the check valve retainer, check valve and non-orbiting scroll of FIG. 1.

As shown in FIG. 2, valve retainer 74 is disposed within valve chamber 70. Valve retainer 74 has body 102 with body top 106 spaced by body side 110 from body bottom 114. Body 102 retains valve 66 within valve chamber 70 after valve retainer 74 is snapped in place. Valve 66 is a check valve that is forced above passage 68 in the direction of arrow X when compressed refrigerant is passed through passage 68 in the same direction. Check valve 66 returns to the position shown in FIG. 2 in the direction of arrow Y when discharge of compressed refrigerant from compression chambers 58 has stopped.

Figure 3:
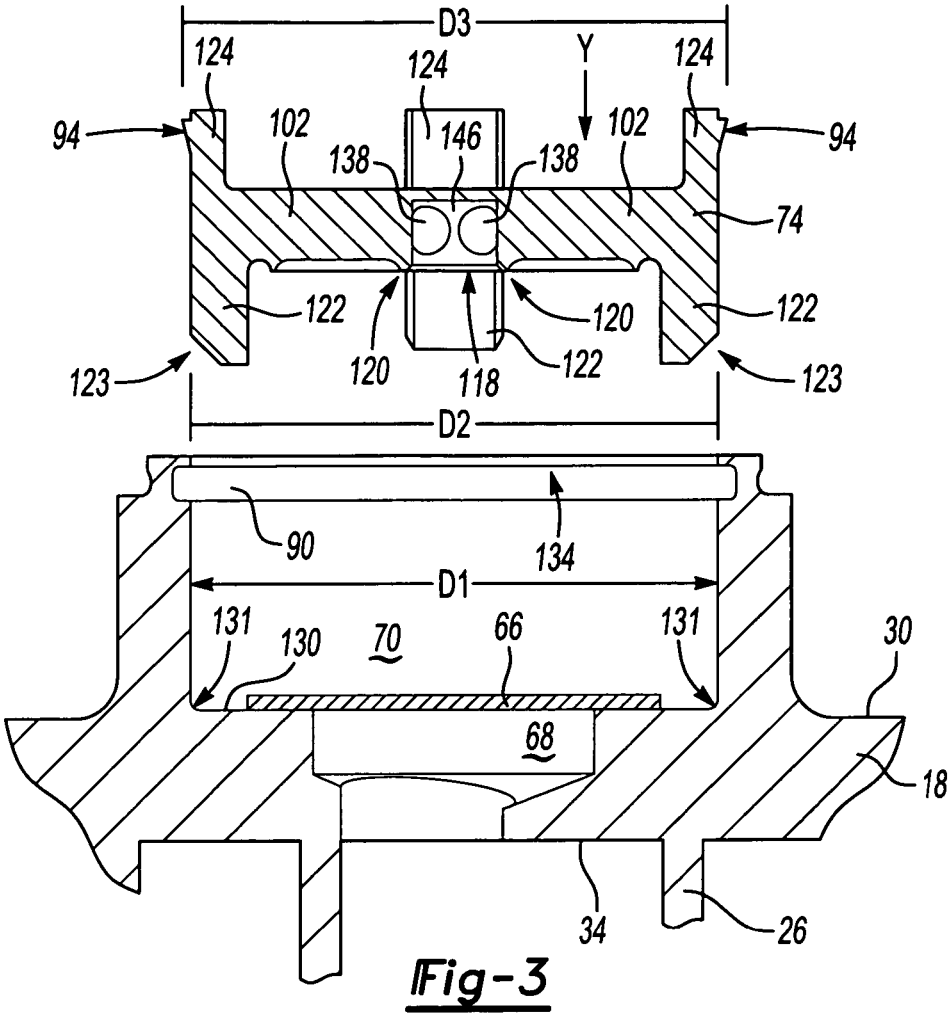
FIG. 3 illustrates the insertion of the check valve retainer within the valve chamber of the non-orbiting scroll.
Figure 4:
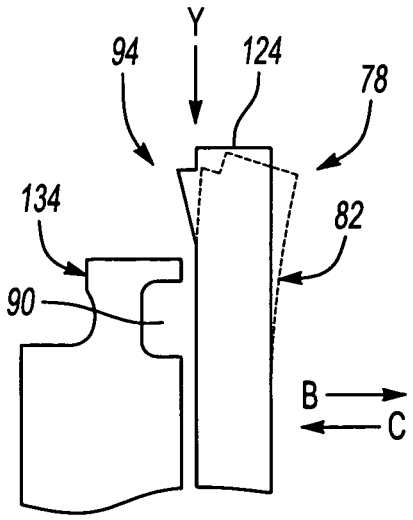
FIG. 4 illustrates the snap fit connection of the inventive valve retainer in the disengaged position.
Figure 5:
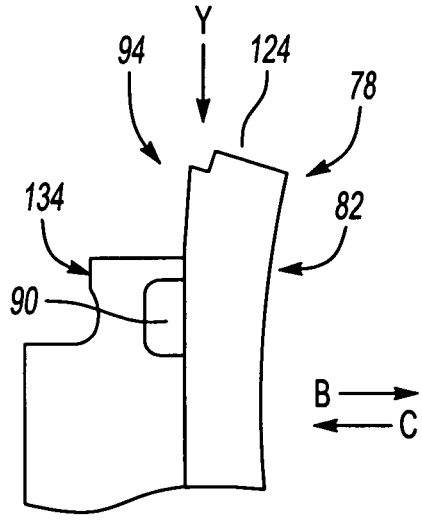
FIG. 5 illustrates the snap fit connection of the valve retainer of FIG. 4 flexing to the engaged position of FIG. 2.

The inventive locking mechanism will now be explained in detail. Valve chamber 70 comprises a cylinder sized to receive round check valve 66. Valve chamber 70 has valve chamber bottom 130 and valve chamber rim 134. At valve chamber rim 134 is located groove 90, which extends circumferentially around valve chamber 70. Following the placement of check valve 66 over passage 68, valve retainer 74 is positioned over valve chamber rim 134 as shown in FIG. 3. Valve retainer 74 is then inserted into valve chamber 70 in the direction of arrow Y. Valve chamber 70 has diameter $D_1$ while valve retainer 74 has diameter $D_2$, not including protrusions 94, here ramps which extend from legs 124. $D_2$ is smaller than $D_1$. However, the diameter of valve retainer 74 as measured from protrusion to protrusion directly across body 102 is distance $D_3$ which is larger than $D_1$. Accordingly, as shown in FIGS. 4 and 5, as legs 124 pass through valve chamber rim 134, protrusion 94 meets valve chamber rim 134 so as to be directed in the direction of arrow B away from rim 134. When protrusion has passed rim 134, protrusion 94 will seat within groove 90 and move in the direction of arrow C to thereby engage valve retainer 74 to first scroll member 18. Therefore, snap fit connection 78 has a disengaged position in which leg 124 is flexed as shown by dashed lines in FIG. 4 and by solid lines in FIG. 5. In this flexed state, leg 124 is in tension and biased to return in the direction of arrow C. Accordingly, when protrusion 94 reaches groove 90, leg 124 moves to a more relaxed and engaged position 86 as shown in FIG. 2. Each of legs 124 has protrusion 94 so that valve retainer 74 may be secured to non-orbiting scroll member 18 at more than one location.

In addition, valve retainer 74 may be pressed into valve chamber 70 so that the top of leg 124 sits at the top of valve chamber rim 134. Valve retainer 74 also has lower legs 122, which serve as a locating stop for valve retainer 74 so that protrusions 94 are not pushed past groove 90 when valve retainer 74 is pushed in the direction of arrow Y. Preferably, lower legs 122 have chamfered edges 123 so that they may sit without hitting corners 131 of valve chamber bottom 130. It is also preferable that corners 131 be rounded to receive lower legs 122.

Figure 6:
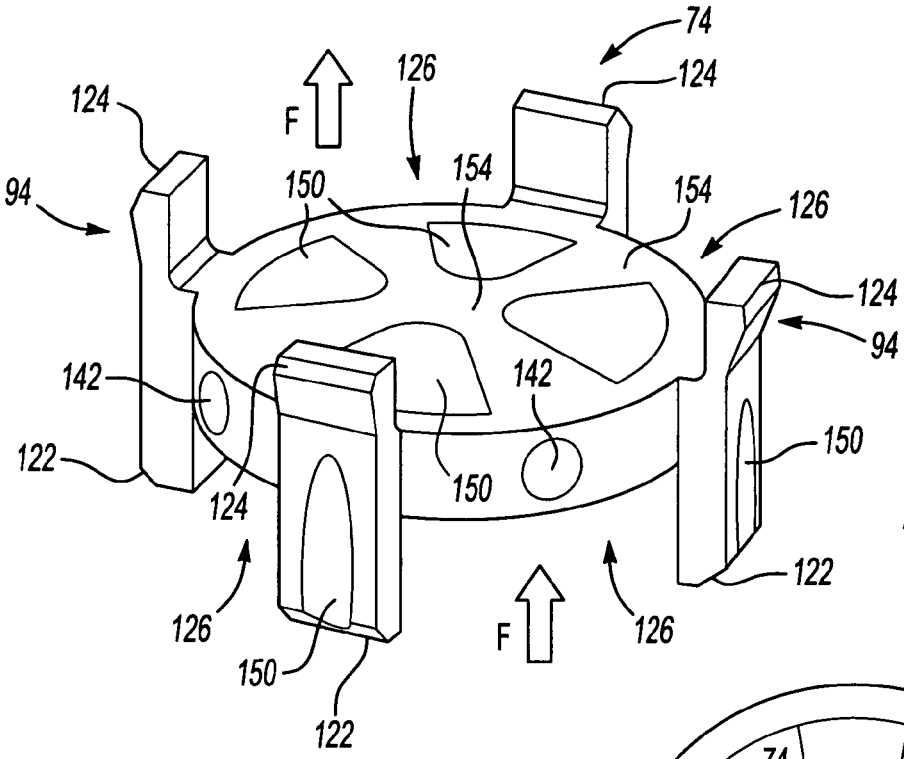
FIG. 6 illustrates a top perspective view of the inventive valve retainer, highlighting the location of gas discharge passages and holes used to create suction at the bottom of the valve retainer.
Figure 6A:
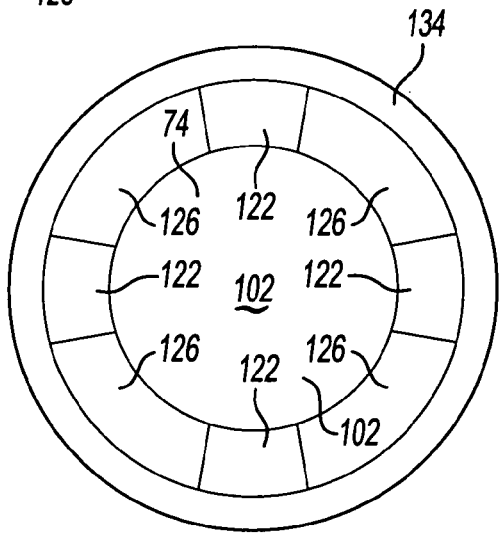
FIG. 6A shows a top view of the inventive valve retainer, including gas discharge passages.
Figure 7:
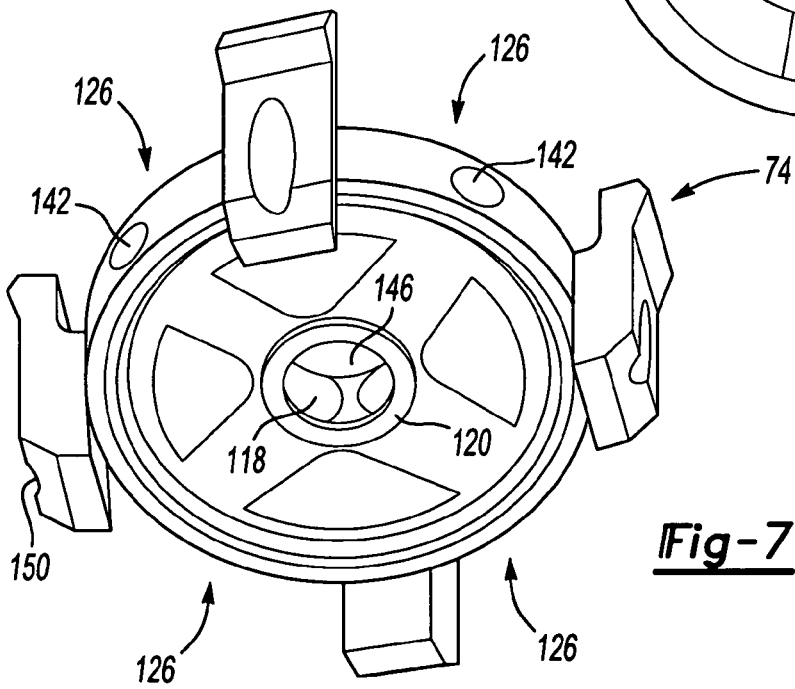
FIG. 7 illustrates a bottom perspective view of the inventive valve retainer of FIG. 6, showing the location of a valve seat.

Valve retainer 74 also has other features. As shown in FIG. 6, valve retainer 74 has discharge openings 126 that permit refrigerant gas shown by arrows F to pass from valve chamber 70 into discharge pressure chamber 38. FIG. 6A shows an overhead view of these discharge openings 126 relative to rim 134 of non-orbiting scroll member 18. Discharge openings 126 are defined by the space between legs 122 and rim 134.

Moreover, valve retainer 74 is provided with pressure holes 142, which extend through channel 138 as shown in FIG. 3 into pressure chamber 146. Pressure chamber 146 has opening 118. As compressed refrigerant F passes by pressure holes 142, a low pressure region is created by Venturi effect in pressure chamber 146. This low pressure region in pressure chamber 146 creates suction at opening 118. Accordingly, as check valve 66 rises in the direction of arrow X, check valve 66 is drawn by suction to opening 118. Opening 118 has valve seat 120 extending circumferentially around opening 118 so as to receive check valve 66. Check valve 66 will accordingly rest on valve seat 120 and not otherwise rattle within valve chamber 70 during refrigerant discharge.

Preferably, valve retainer 74 is made of metal by a metal injection process. In such an instance, valve retainer 74 is provided with relief 150 to reduce the thickness of valve retainer 74 to improve injection molding. In addition, valve retainer 74 may be provided with ribs 154 to reinforce the structural integrity of body top 106. By molding valve retainer 74 in this fashion, the cost of producing this part is significantly reduced. Valve retainer 74 may also be made by machining or by known powered metal processes.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A scroll compressor comprising:

a sealed housing;

a first scroll member having a first base and a first generally spiral wrap extending from said first base, a discharge pressure chamber on a first side of said first base and a suction pressure chamber on a second side of said first base;

a second scroll member having a second base and a second generally spiral wrap extending from said second base, said wraps of said first and second scroll members interfitting to define compression chambers;

a motor for driving said second scroll member to orbit relative to said first scroll member;

a valve for controlling the communication of gas between said compression chambers and said discharge pressure chamber, said valve disposed in a valve chamber of said first scroll member; and a valve retainer for said valve, wherein said valve retainer includes a snap fit connector to mount said valve retainer to said first scroll member, said snap fit connector flexible between a disengaged position wherein said valve retainer is disengaged from said first scroll member and an engaged position wherein said valve retainer is engaged to said first scroll member, wherein said valve retainer has a body spaced from a valve chamber bottom of said valve chamber, said valve spaced between said body and said valve chamber bottom, wherein said body has a body top spaced by a body side from a body bottom, said body having a pressure hole for creating suction on said body bottom for retaining said valve.

2. A scroll compressor comprising:

a sealed housing;

a first scroll member having a first base and a first generally spiral wrap extending from said first base, said first scroll member defining a discharge pressure chamber on a first side of said first base and a suction pressure chamber on a second side of said first base;

a second scroll member having a second base and a second generally spiral wrap extending from said second base, said wraps of said first and second scroll members interfitting to define compression chambers;

a motor for driving said second scroll member to orbit relative to said first scroll member;

a valve for controlling the communication of gas between said compression chambers and said discharge pressure chamber, said valve disposed in a valve chamber of said first scroll member;

a valve retainer for said valve;

a snap fit connector mounting said valve retainer to said first scroll member, said snap fit connector flexible between a disengaged position wherein said valve retainer is disengaged from said first scroll member and an engaged position wherein said valve retainer is engaged to said first scroll member;

wherein said valve retainer has a body spaced from a valve chamber bottom of said valve chamber, said valve spaced between said body and said valve chamber bottom, said body having at least one leg extending from said body toward said valve chamber bottom and at least partially contacting said valve chamber bottom; and wherein said snap fit connector comprises an opening and a protrusion, said protrusion disposed in said opening when in said engaged position and said protrusion out of said opening when in said disengaged position.

3. The scroll compressor of claim 2 wherein said opening comprises a groove and said protrusion comprises a ridge sized to be received by said groove.

4. The scroll compressor of claim 3 wherein said groove is disposed on said valve chamber and said ridge is disposed on said valve retainer.

5. The scroll compressor of claim 2 wherein said protrusion is disposed on one of said at least one leg and said valve chamber.

6. The scroll compressor of claim 5 wherein said leg is flexible between said engaged position and said disengaged position.

7. The scroll compressor of claim 2 wherein said at least one leg comprises a first leg and a second leg, a discharge passage for communicating gas from said valve chamber to said discharge pressure chamber spaced between said first leg and said second leg.

8. A scroll compressor comprising:

a sealed housing;

a first scroll member having a first base and a first generally spiral wrap extending from said first base, said first scroll member defining a discharge pressure chamber on a first side of said first base and a suction pressure chamber on a second side of said first base;

a second scroll member having a second base and a second generally spiral wrap extending from said second base, said wraps of said first and second scroll members interfitting to define compression chambers;

a motor for driving said second scroll member to orbit relative to said first scroll member;

a valve for controlling the communication of gas between said compression chambers and said discharge pressure chamber, said valve disposed in a valve chamber of said first scroll member;

a valve retainer for said valve;

a snap fit connector mounting said valve retainer to said first scroll member, said snap fit connector flexible between a disengaged position wherein said valve retainer is disengaged from said first scroll member and an engaged position wherein said valve retainer is engaged to said first scroll member;

wherein said valve retainer has a body spaced from a valve chamber bottom of said valve chamber, said valve spaced between said body and said valve chamber bottom, wherein said body has a body top spaced by a body side from a body bottom, said body having a pressure hole for creating suction on said body bottom for retaining said valve; and wherein said snap fit connector comprises an opening and a protiusion, said protrusion disposed in said opening when in said engaged position and said protrusion out of said opening when in said disengaged position.

9. A scroll compressor comprising:

a sealed housing;

a first scroll member having a first base and a first generally spiral wrap extending from said first base, a discharge pressure chamber on a first side of said first base and a suction pressure chamber on a second side of said first base;

a second scroll member having a second base and a second generally spiral wrap extending from said second base, said wraps of said first and second scroll members interfitting to define compression chambers;

a motor for driving said second scroll member to orbit relative to said first scroll member;

a valve for controlling the communication of gas between said compression chambers and said discharge pressure chamber, said valve disposed in a valve chamber of said first scroll member; and a valve retainer for said valve, wherein said valve retainer includes a snap fit connector to mount said valve retainer to said first scroll member, said snap fit connector flexible between a disengaged position wherein said valve retainer is disengaged from said first scroll member and an engaged position wherein said valve retainer is engaged to said first scroll member, wherein said valve retainer defines a pressure chamber having at least one opening, wherein said opening includes a valve seat that extends circumferentially around said opening to receive said valve.

* * * * *

UNITED STATES PATENT AND TRADEMARK OFFICE

CERTIFICATE OF CORRECTION

PATENT NO. : 7,261,527 B2
APPLICATION NO. : 10/827411
DATED : August 28, 2007
INVENTOR(S) : Alexander et al.

It is certified that error appears in the above-identified patent and that said Letters Patent is hereby corrected as shown below:

Claim 8, Column 7, line 5: “protiusion” should read as --protrusion--

Signed and Sealed this

Eighteenth Day of December, 2007

JON W. DUDAS
*Director of the United States Patent and Trademark Office*